US008747071B2

(12) United States Patent
Kato et al.

(10) Patent No.: US 8,747,071 B2
(45) Date of Patent: Jun. 10, 2014

(54) DRAIN PUMP

(75) Inventors: Yuya Kato, Tokyo (JP); Shinichi Nemoto, Tokyo (JP); Kenji Yamabiraki, Toyo (JP); Katsushi Sato, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 414 days.

(21) Appl. No.: 12/828,483

(22) Filed: Jul. 1, 2010

(65) Prior Publication Data

US 2011/0008153 A1 Jan. 13, 2011

(30) Foreign Application Priority Data

Jul. 7, 2009 (JP) ..... 2009-161143
Sep. 24, 2009 (JP) ..... 2009-219512

(51) Int. Cl.
*F04D 13/12* (2006.01)

(52) U.S. Cl.
USPC ..... 416/183; 416/185; 415/143

(58) Field of Classification Search
USPC ..... 415/143; 416/182, 183, 185, 175, 195, 416/203
See application file for complete search history.

(56) References Cited

U.S. PATENT DOCUMENTS 2,753,808 A * 7/1956 Kluge ..... 416/183
4,502,837 A * 3/1985 Blair et al. ..... 415/198.1
4,759,272 A * 7/1988 Zaniewski ..... 454/344

FOREIGN PATENT DOCUMENTS

EP 1617084 A1 * 1/2006
JP 09-068185 3/1997
JP 2004-138075 5/2004
JP 2007-127078 5/2007

* cited by examiner

*Primary Examiner* — Ned Landrum
*Assistant Examiner* — Justin Seabe
(74) *Attorney, Agent, or Firm* — Fildes & Outland, P.C.

(57) ABSTRACT

A drain pump that maintains pump performance and reduces noise and vibration accompanying water scooping of a rotary impeller includes a large-diameter blade divided into an inner blade and an outer blade. A radius of an impeller scooping up water is the sum of the lengths of the inner and outer blades in a radial direction. The large-diameter blade is divided at a position where the amount of generated air bubbles is large, and the inner and outer blades are alternately disposed. Accordingly, air bubbles are escaped to a downstream side in a rotational direction, so that the intensity of the collision between the blades and air bubbles is decreased reducing noise caused by the burst of air bubbles and vibration caused by a collision load of the flow of a gas-liquid mixture.

9 Claims, 23 Drawing Sheets

AXIAL DIRECTION

Fig. 13

HEAD CAPACITY

| ITEM | DRAIN PUMP IN RELATED ART | DRAIN PUMP OF THE INVENTION |
|---|---|---|
| AMOUNT OF DISCHARGED WATER [$cm^3$/min] | 572 | 568 |
| SHUT OFF HEAD [mm] | 1920 | 1905 |

DRAIN PUMP

The present application is based on and claims priorities of Japanese patent applications No. 2009-161143 filed on Jul. 7, 2009 and No. 2009-219512 filed on Sep. 24, 2009, the entire contents of which are hereby incorporated by reference.

BACKGROUND OF THE INVENTION

1. Field of the Invention

The present invention relates to a drain pump provided in, particularly, an air-conditioner.

2. Description of the Related Art

Moisture in the air is condensed and attached to a heat exchanger during a cooling operation of an indoor unit of an air-conditioner, and water droplets drop into a drain pan provided below the heat exchanger. A drain pump is provided in the indoor unit in order to drain away drain water stored in the drain pan. An example of the drain pump, there is a drain pump where an inlet is formed at a lower end portion of a housing, an outlet is formed at a side portion of the housing, a rotary impeller is rotatably provided in the housing, a motor is fixed to an upper opening of the housing with a cover interposed therebetween, and the rotary impeller is rotated by the motor. When the rotary impeller is rotated by the drive of the motor, the drain water stored in the drain pan is sucked from the lower end of the inlet, is pumped along an inner surface of the housing, and is discharged to the outside from the outlet of the housing.

As the related art of this kind of drain pump, there is a drain pump disclosed in Japanese Patent Application Laid-Open (JP-A) No. 09-68185. FIG. 22 is a front view showing the partial cross-section of the entire structure of a drain pump disclosed in JP-A No. 09-68185, and FIG. 23 shows a top view and a side view of a rotary impeller of the drain pump. The drain pump, which is denoted by reference numeral 1, includes a motor 10 and a pump body 30 mounted below the motor 10 by a bracket 20. The bracket 20 is formed integrally with a cover 32 that covers an upper opening of the housing 40, and the cover 32 is connected to the housing 40 with a seal member 34 interposed therebetween. The housing 40 is made of plastic. The housing includes a pipe-like inlet 42 opened to the lower side, a pump chamber 44 formed in the housing, and an outlet 46 opened to the side. A suction end portion 43 of the inlet 42 is formed by a tapered surface of which an inner diameter is decreased toward an opened end.

A rotary impeller 50, which is rotated by the output of the motor 10, is received in the pump chamber 44 of the housing 40. The rotary impeller 50 includes a shaft portion 52, a plurality of flat plate-like large-diameter blades 60 that extends from an outer peripheral portion of an upper portion of the shaft portion 52 in a radial direction, and a plurality of flat plate-like small-diameter blades 54 that is connected to lower edge portions of the respective large-diameter blades 60 and is received in the inlet 42. The shaft portion 52 protrudes toward the motor 10 through a through hole 36 formed at the center of the cover 32, and a drive shaft 12 of the motor 10 is inserted into and fixed to a hole 53 formed at the center of an upper end of the shaft portion 52. A circular deflector board 14 is mounted on an upper surface of the shaft portion 52, and the circular deflector board 14 prevents drain water, which is ejected through the through hole 36 of the cover 32, from being scattered toward the motor 10.

Lower edge portions of the large-diameter blades 60 are formed in a tapered shape, and the lower edge portions are connected to each other by a disk-shaped annular member 62 that includes an opening 63 at the center of a lower edge portion. The small-diameter blade 54 and the large-diameter blade 60 are made of a resin and formed integrally with each other, and are disposed below the large-diameter blade 60. An auxiliary blade 68 is provided between the large-diameter blades 60 and 60, which are adjacent to each other, and it can secure a head of the pump by the auxiliary blades 68 and the large-diameter blades 60.

The outer peripheral ends of the large-diameter blades 60 and the auxiliary blades 68 are connected to each other by a ring member 64. The position of an upper edge portion of the ring member 64 is lower than the positions of the upper edge portions of the large-diameter blades 60 and the auxiliary blades 68. Air bubbles, which are generated in liquid by the rotation of the large-diameter blades 60, smoothly flow to the outlet 46 by the ring member 64. Accordingly, the collision between the air bubbles and a bottom face 35 of the cover 32 is mitigated, so that noise is reduced. Further, return water, which returns to a pump chamber 44 of the housing 40 from the outlet 46, is generated when a drain pump 1 is stopped. However, the return water bumps against the ring member 64 and is gradually diffused due to the buffering of the ring member 64, so that noise caused by the return water is also reduced. Meanwhile, if the position of the upper edge portion of the ring member 64 is set to be above or the same as the positions of the upper edge portions of the large-diameter blades 60 and the auxiliary blades 68 according to pump capacity (a head to be used), it may be possible to reduce noise.

A lower end portion of the ring member 64 is connected to an annular member 62, which connects the lower edge portions of the auxiliary blades 68 and the large-diameter blades 60, in an annular shape. The surface of drain water supplied upward from the inlet 42 is divided substantially in a vertical direction by the annular member 62, so that the amount of water coming into contact with the large-diameter blades 60 is decreased and the generation of air bubbles is suppressed. The inner peripheral portion of the annular member 62 has an opening 63 between the shaft portion 52 and itself. The lower edge portions of the auxiliary blades 68 and the large-diameter blades 60 are formed to be inclined toward small-diameter blades 64, and the annular member 62 is also formed in the shape of a dish so as to correspond to the inclination of the lower edge portions.

This kind of drain pump is also disclosed in, for example, JP-A Nos. 2004-138075 and 2007-127078 filed by the present applicant.

When power is supplied to an air-conditioner and the above-mentioned drain pump 1 begins to operate, drain water is splashed to the small-diameter blade 54, and torque is applied, so that suction begins and water is gradually introduced into the pump chamber 44. Water and air are mixed in the pump chamber 44 and gas-liquid mixture fluid collides with the rotary impeller 50. This collision causes vibration or noise of the scooping of water.

In the rotary impeller 50, many air bubbles generated at a gas-liquid boundary directly collide with the front surface of the large-diameter blade 60 and burst, and air bubbles are generated on the downstream side of the large-diameter blade 60. For this reason, cavitation noise and vibration are increased.

Further, when air bubbles, which are generated at the time of the start-up of the drain pump by the water scooping of the blade, collide with the inner wall of the housing and burst, cavitation noise is generated. The present applicant has proposed a drain pump that may reduce noise by modifying the shape of the inner portion of the upper edge portion of a cylindrical wall member of the rotary impeller in JP-A Nos. 09-68185, 2004-138075, and 2007-127078.

If the position of the upper edge portion of the ring member 64 is lower than the position of the upper edge portion of the large-diameter blade 60, it may be possible to reduce noise to some extent. However, the more efficient reduction of noise has not been particularly considered.

SUMMARY OF THE INVENTION

An object of the present invention is to provide a drain pump which is capable of reducing noise and vibration accompanying with the water scooping of a rotary impeller while maintaining pump performance, such as a head and the amount of discharged water.

Further, another object of the invention is to provide a drain pump that reduces noise by modifying the shape of an outer portion of an upper edge portion of a cylindrical wall member of a rotary impeller.

In order to solve the above problems, according to the invention, there is provided a drain pump including: a motor; a rotary impeller connected to an output shaft of the motor; and a housing that includes an inlet formed at a lower end portion thereof and an outlet formed at a side portion thereof, the rotary impeller being rotatably received in the housing, wherein the rotary impeller includes a shaft portion connected to the output shaft of the motor, a plurality of plate-like large-diameter blades that extends from the shaft portion in a radial direction, a plurality of plate-like small-diameter blades connected to lower edge portions of the large-diameter blades and is received in the inlet, and a ring member connected to outer peripheral portions of the large-diameter blades, each of the large-diameter blades is divided into an inner blade that extends outward from the shaft portion, and an outer blade that extends inward from the ring member, and the inner and outer blades are alternately disposed around the shaft portion.

According to the drain pump of the invention, the large-diameter blade is divided into the inner and outer blades, and the inner and outer blades are alternately disposed around the shaft portion, so that air bubbles may be escaped to the downstream side in the rotational direction through gaps between the inner and outer blades, gaps between the inner blades and the ring member, and gaps between the outer blades and the shaft portion. Accordingly, the amount of air bubbles colliding with the large-diameter blades is decreased and noise caused by the burst of air bubbles may be decreased. Further, since a force applied to the large-diameter blade in a direction opposite to the rotational direction is decreased, a load is decreased and vibration is reduced. If a distance R2 between the center of the shaft portion and an inner end of the outer blade in the radial direction is set to be substantially equal to a distance R1 between the center of the shaft portion and an outer end of the inner blade in the radial direction, the length of the large-diameter blade of the invention, which scoops up water, in the radial direction is substantially equal to the length of the large-diameter blade in the related art in the radial direction. Accordingly, it may be possible to secure the same pump performance as that of the drain pump in the related art. Further, if the area of the opening of the inlet and the area of the flow passage of the drain pump according to the invention are set to be substantially equal to those of the drain pump in the related art, it may be possible to secure the same amount of discharged water as that of the drain pump in the related art.

Furthermore, in order to achieve the above objects, according to the invention, there is provided a drain pump including a motor, a rotary impeller connected to an output shaft of the motor, and a housing that receives the rotary impeller as a basic unit. The housing includes an inlet formed at a lower portion thereof and an outlet formed at a cylindrical side portion of a pump chamber. The rotary impeller includes a shaft portion connected to the output shaft of the motor, plate-like large-diameter blades that extend from the shaft portion in a radial direction, plate-like small-diameter blades that are connected to the large-diameter blades by connecting portions and are received in the inlet, a ring member provided at outer peripheral portions of the large-diameter blades, and an annular member that is connected to a lower end portion of the ring member and includes an opening at a central portion thereof. An outer portion of an upper edge portion of the ring member is formed in a shape where the thickness of the ring member is decreased, so that an expanded space is formed between the pump chamber the outer portion of the upper edge portion of the ring member.

According to the drain pump of the invention, it may be possible to reduce the operation sound such as water scooping sound.

BRIEF DESCRIPTION OF THE DRAWINGS

FIG. 13 is a table showing the head capacity of the drain pump according to the invention and the head capacity of a drain pump in the related art;

DETAILED DESCRIPTION OF THE PREFERRED EMBODIMENTS

Figure 1:
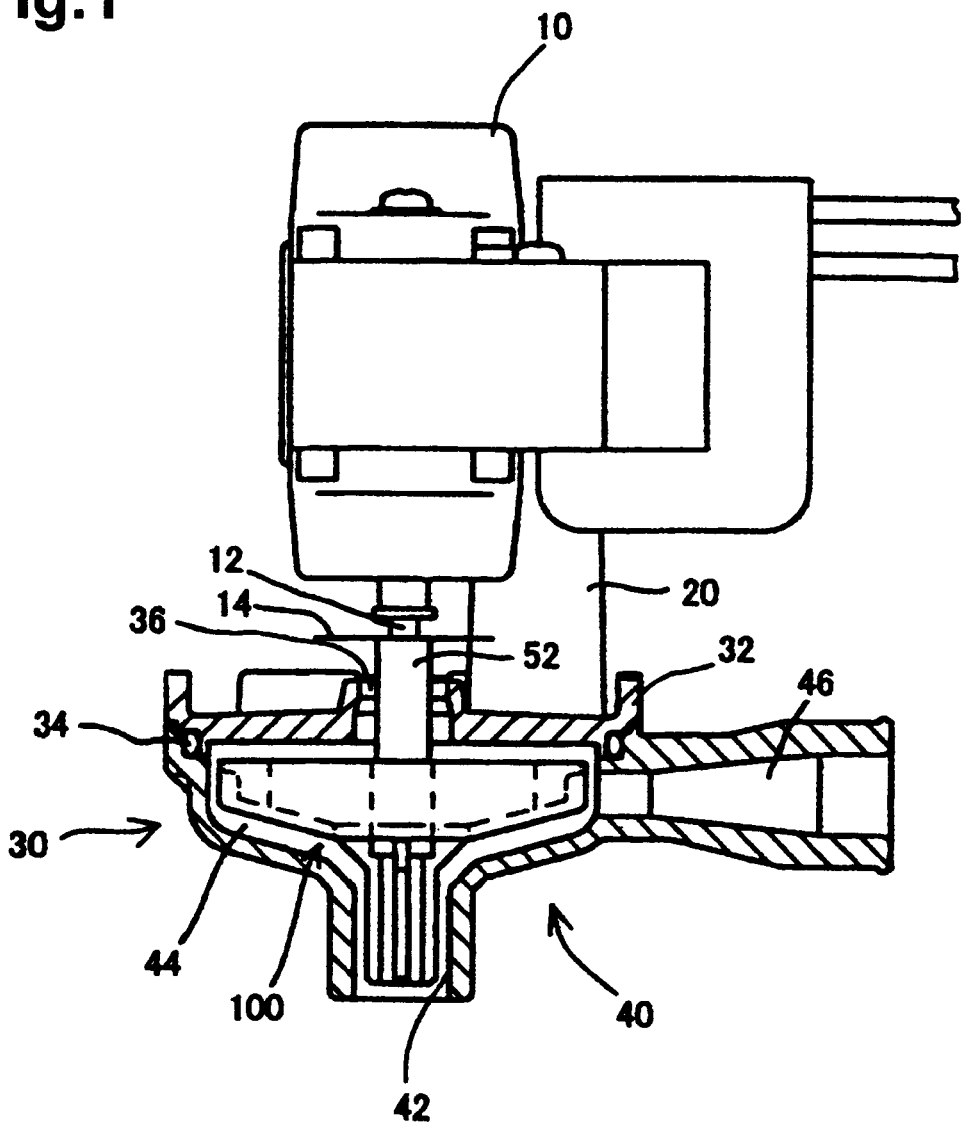
FIG. 1 is a front view showing the partial cross-section of an example of a drain pump according to the invention.
Figure 2A:
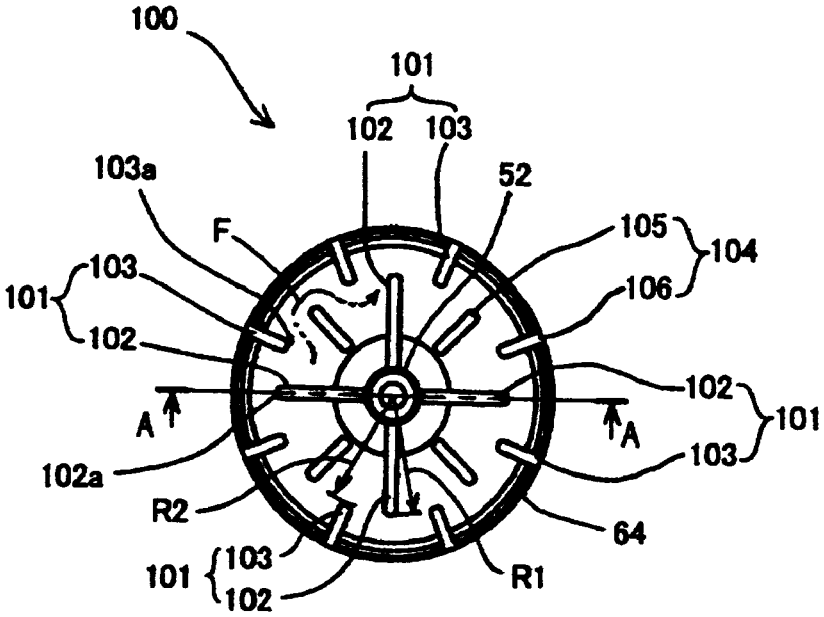
FIG. 2 is a view showing an embodiment of a rotary impeller used in the drain pump according to the invention.
Figure 2B:
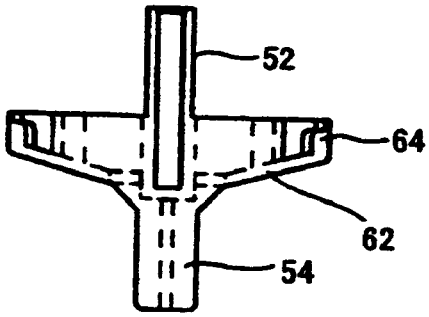
Figure 2C:
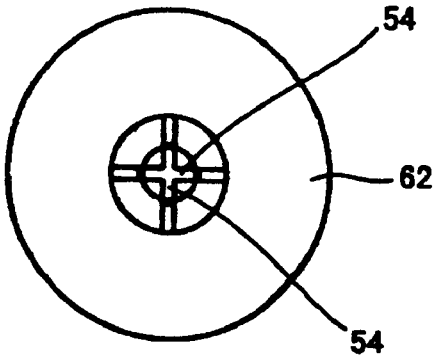
Figure 22:
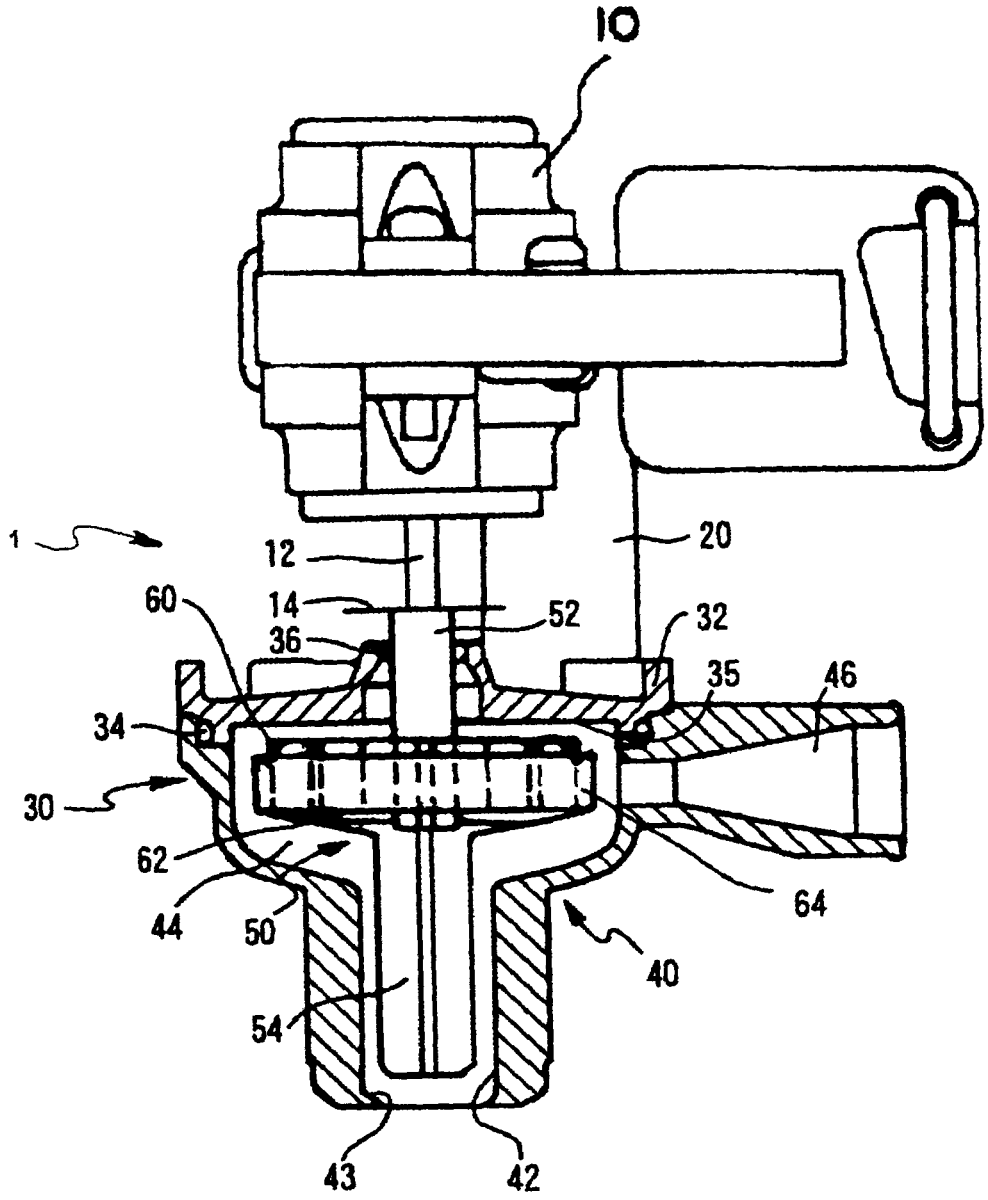
FIG. 22 is a front view showing the partial cross-section of an example of a drain pump in the related art.
Figure 23A:
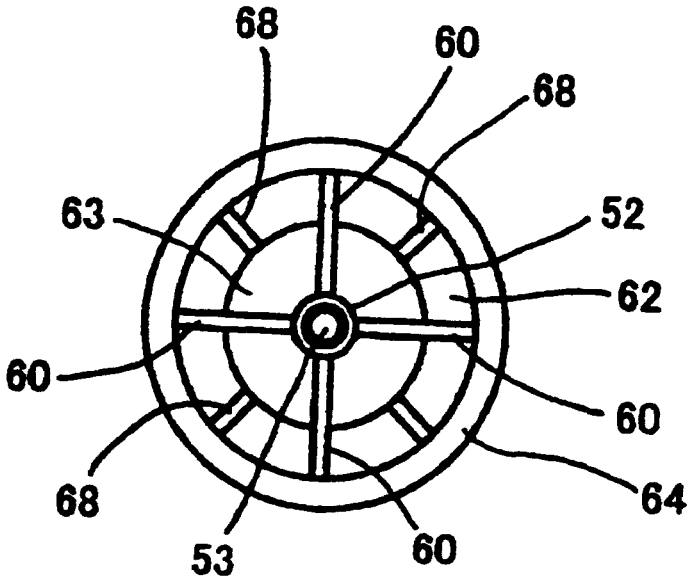
FIG. 23A is a top view of a rotary impeller of the drain pump shown in FIG. 22.
Figure 23B:
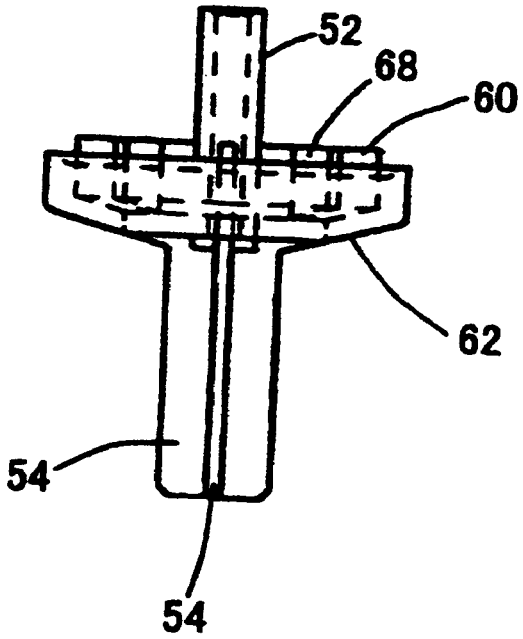
FIG. 23B is a side view of a rotary impeller of the drain pump shown in FIG. 22.

Embodiments of a drain pump according to the invention will be described below with reference to drawings. FIG. 1 is a front view showing the partial cross-section of an example of a drain pump according to the invention, and FIG. 2 shows an embodiment of a rotary impeller used in the drain pump shown in FIG. 1. FIG. 2A is a top view of the rotary impeller. FIG. 2B is a cross-sectional view of the rotary impeller shown in FIG. 2A, taken along a line A-A of FIG. 2A. FIG. 2C is a bottom view of the rotary impeller shown in FIG. 2A. The same components of the drain pump, which is provided with the rotary impeller, as those of the drain pump shown in FIGS. 22 and 23 are denoted by the same reference numerals, and the description thereof will not be repeated. Further, the same components of the rotary impeller except for the components of the rotary impeller, which shows characteristics of the invention, as those of the rotary impeller shown in FIGS. 22 and 23 are also denoted by the same reference numerals, and the description thereof will not be repeated.

In the rotary impeller 100 shown in FIG. 2, each large-diameter blade 101 is divided into an inner blade 102 and an outer blade 103. The inner blade 102 extends outward from a shaft portion 52 in a radial direction, and the outer blade 103 extends inward from a ring member 64 in the radial direction. The inner and outer blades 102 and 103 are alternately disposed around the shaft portion 52.

Figure 4:
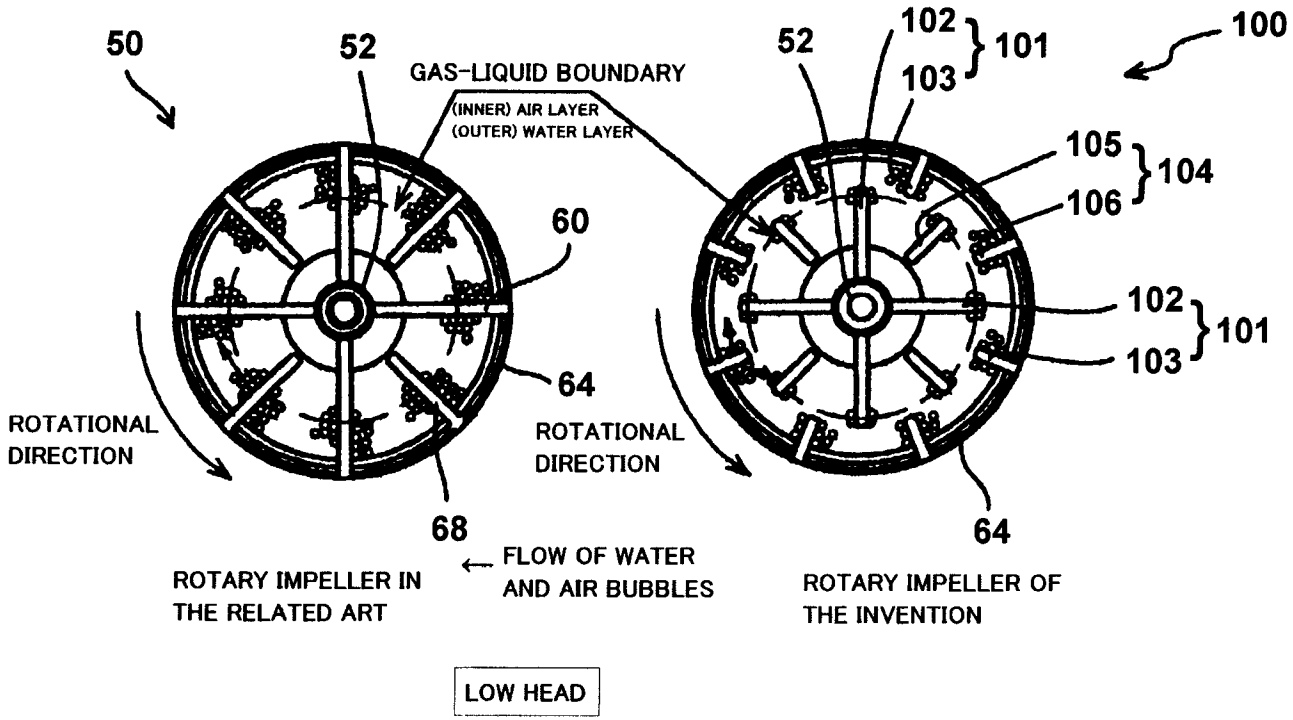
FIG. 4 is an explanatory view comparatively showing the conditions of gas-liquid boundaries during the low-head operation of the rotary impeller shown in FIG. 2 and a rotary impeller in the related art.
Figure 5:
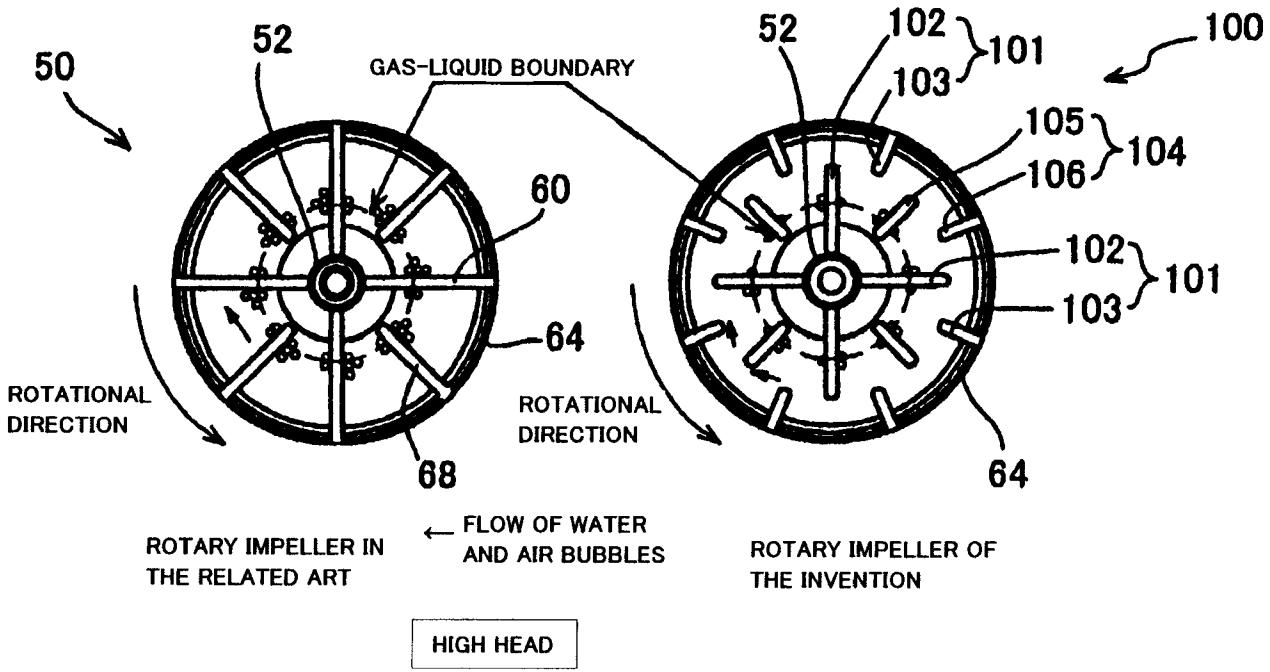
FIG. 5 is an explanatory view comparatively showing the conditions of gas-liquid boundaries during the high-head operation of the rotary impeller shown in FIG. 2 and a rotary impeller in the related art.

The conditions of gas-liquid boundaries during the low-head operation (FIG. 4) and the high-head operation (FIG. 5) of the drain pump according to the invention are schematically shown in FIGS. 4 and 5 while being compared with those of a drain pump in the related art. During the low-head operation (FIG. 4), the vicinities (positions shown by a circle that is shown by a dashed dotted line) of positions where the large-diameter blades 101 are divided into the inner and outer blades 102 and 103 substantially become a gas-liquid boundary. The inside of the gas-liquid boundary is a region of an air layer, and the outside of the gas-liquid boundary is a region of a water layer. That is, the large-diameter blade 101 is divided into the inner and outer blades 102 and 103 at a position where the amount of generated air bubbles is large. A position where the large-diameter blade 101 is divided is set according to the head with which noise is to be reduced. That is, it is effective to divide the large-diameter blade 101 into the inner and outer blades 102 and 103 in the vicinity of the gas-liquid boundary, which is generated in the rotary impeller 100, at the time of the head with which noise is to be reduced.

When the rotary impeller 100 is rotated in a direction indicated by a shown arrow, air bubbles and water flow in the rotary impeller 100 as shown by the arrow, the air bubbles pass between the inner and outer blades without colliding with the inner and outer blades 102 and 103, and it may be possible to reduce the amount of air bubbles generated on the downstream side. If the rotary impeller has the structure where air bubbles are escaped through gaps between the inner and outer blades 102 and 103, gaps between the inner blades 102 and the ring member 64, and gaps between the outer blades 103 and the shaft portion 52 as described above, the amount of air bubbles colliding with the blades is decreased. Accordingly, cavitation caused by the burst of air bubbles is decreased, so that noise and vibration may be reduced. Further, if air bubbles collide with the blade, a force in a direction opposite to the rotational direction of the rotary impeller is applied to the blade. However, if an escape route for water is formed, a force applied to each blade in the opposite direction is decreased. As a result, a load is decreased.

As a head is increased, the diameter of the gas-liquid boundary is decreased as shown during the high-head operation (see FIG. 5), the amount of water scooped up by the inner and outer blades 102 and 103 is increased, and air bubbles exist near only the inner blades 102. If the amount of scooped water is increased, a load is increased. Accordingly, the rotational speed of the rotary impeller 50 is decreased as compared to the time of the start-up. If the diameter of the gas-liquid boundary is decreased and the rotational speed of the rotary impeller 50 is decreased, the intensity of the collision between the rotary impeller 100 and air bubbles is decreased. Accordingly, cavitation noise is reduced. Further, since water is escaped to the downstream side from the gaps between the inner blade 102 and the ring member 64 and gaps between the inner and outer blades 102 and 103, a load per blade may be decreased and vibration may be decreased as compared to that in the related art.

Figure 11:
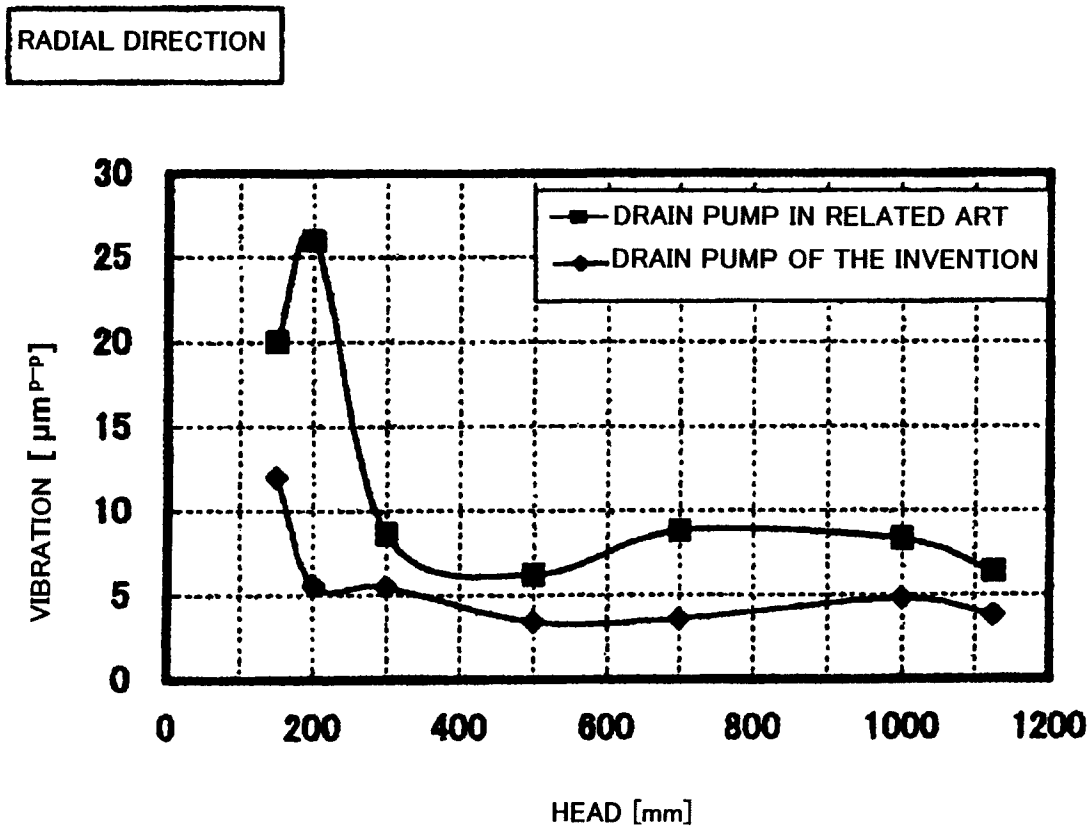
FIG. 11 is a graph showing a relationship between the head of the drain pump according to the invention and the intensity of radial vibration (peak to peak) according to the head, and a relationship between the head of a drain pump in the related art and the intensity of radial vibration (peak to peak) according to the head.
Figure 12:
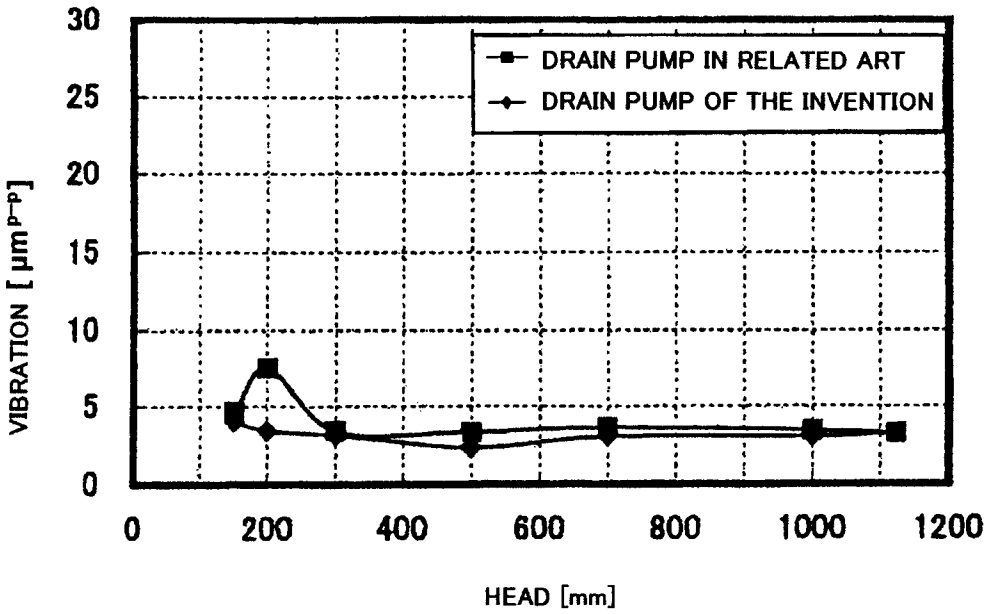
FIG. 12 is a graph showing a relationship between the head of the drain pump according to the invention and the intensity of axial vibration (peak to peak) according to the head, and a relationship between the head of a drain pump in the related art and the intensity of axial vibration (peak to peak) according to the head.

A graph of FIG. 11 shows a relationship between the head of the drain pump according to the invention and the intensity of radial vibration (peak to peak) according to the head and a relationship between the head of a drain pump in the related art and the intensity of radial vibration (peak to peak) according to the head. FIG. 12 shows a relationship between the head of the drain pump according to the invention and the intensity of axial vibration (peak to peak) according to the head and a relationship between the head of a drain pump in the related art and the intensity of axial vibration (peak to peak) according to the head. As shown in FIGS. 11 and 12, particularly, radial vibration (peak to peak) of the drain pump according to the invention has been significantly improved in the low-head operation. Further, in the case of any head, the vibration of the drain pump according to the invention has been generally decreased than that of the drain pump in the related art.

The lengths of the respective inner and outer blades 102 and 103 in the radial direction may be set according to the head in actual use. That is, assuming that the radius of the impeller is represented by "r", "$head=r^2\times\omega^2\div(2\times g)$" is satisfied. If the sum of the lengths of the respective inner and outer blades 102 and 103 in the radial direction is set to be equal to the length of the large-diameter blade in the related art in the radial direction, the radius r of the impeller scooping up water may not be changed. Accordingly, it may be possible to secure the same pump performance as that of the drain pump in the related art.

That is, in the embodiment shown in FIG. 2, a distance R2 between the center of the shaft portion 52 and an inner end 103*a* of the outer blade 103 in the radial direction is set to be substantially equal to a distance R1 between the center of the shaft portion 52 and an outer end 102*a* of the inner blade 102 in the radial direction. If a relationship between the distances R1 and R2 is maintained, it may be possible to secure the same pump performance as the performance of the drain pump in the related art. In addition, the flow F of the mixture of air bubbles and water easily passes between the inner end 103*a* of the outer blade 103 in the radial direction and the outer end 102*a* of the inner blade 102 in the radial direction. That is, an escape route for air bubbles is secured, so that the collision between air bubbles and the inner or outer blade 102 or 103 is suppressed. As a result, cavitation noise and vibration, which are caused by the burst of air bubbles, are reduced. Meanwhile, the distance R2 may be larger than the distance R1. In contrast, if the distance R2 is set to be sufficiently smaller than the distance R1, the condition of the collision between the rotary impeller 100 and the flow of a gas-liquid mixture is not changed from the condition of collision in the related art. Accordingly, an effect and operation of reducing noise and vibration is decreased.

Figure 3A:
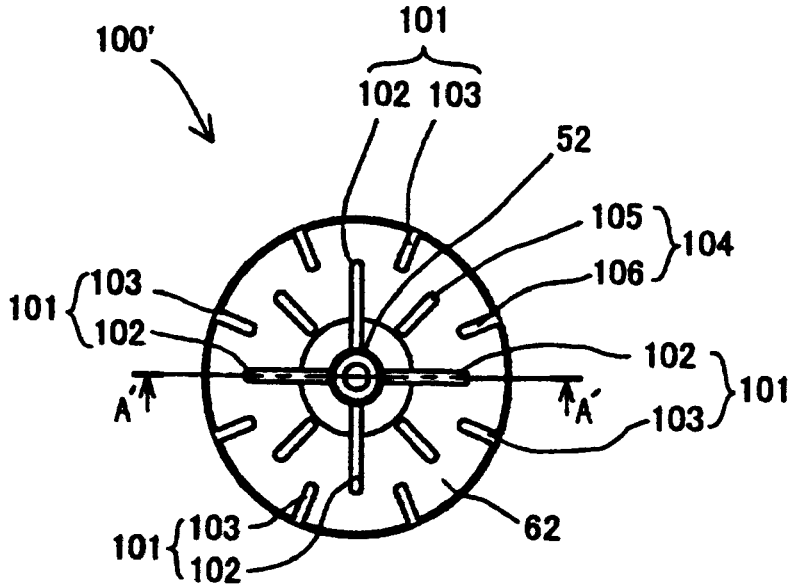
FIG. 3 is a view showing a modification of the rotary impeller of FIG. 2.
Figure 3B:
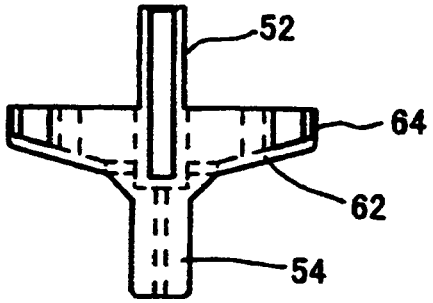
Figure 3C:
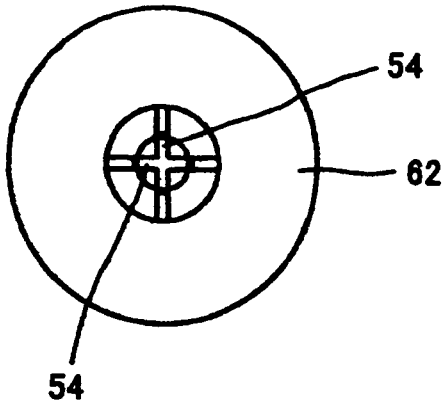

FIG. 3 is a view showing a modification of the rotary impeller of FIG. 2, FIG. 3A is a top view, FIG. 3B is a cross-sectional view taken along a line A'-A' of FIG. 3A, and FIG. 3C is a bottom view of FIG. 3A. In FIG. 2, the ring member 64 has been formed in a stepped shape. If the ring member 64 is formed to be straight and thin as shown in FIG. 3, flow passages in a rotary impeller 100' are widened and a gas-liquid mixture more easily flows. Accordingly, an effect of reducing noise and vibration is further improved.

Further, in order to secure the amount of water to be discharged, the area of an opening of an inlet 42 and the area of the flow passage have not been changed from those of the drain pump in the related art. As for the pump performance, as shown in FIG. 13, it is confirmed that the drain pump according to the invention can secure the same capacity as the capacity of the drain pump in the related art in terms of the amount of discharged water and a shut off head.

The rotary impeller 100 shown in FIG. 2 includes plate-like auxiliary blades 104, which extend in the radial direction, between the large-diameter blades 101 and 101 that are adjacent to each other in a circumferential direction of the shaft portion 52. Meanwhile, in order to easily refer to drawings, reference numeral 104 is given to only one auxiliary blade. The auxiliary blade 104 is divided into an inner auxiliary blade 105 that extends in the radial direction at a position separated from the shaft portion 52 and the ring member 64, and an outer auxiliary blade 106 that extends inward from the ring member 64 in the radial direction. The inner blade 102 of the large-diameter blade 101 and the inner auxiliary blade 105 of the auxiliary blade 104, and the outer blade 103 of the large-diameter blade 101 and the outer auxiliary blade 106 of the auxiliary blade 104 are alternately disposed around the shaft portion 52. The auxiliary blades 104 are provided between the large-diameter blades 101 and 101 as described above, which makes it possible to secure a large head.

Figure 6A:
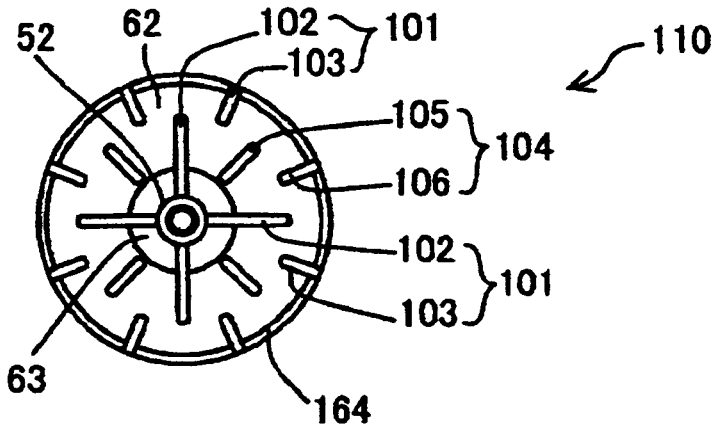
FIG. 6 is a view showing another embodiment of the rotary impeller used in the drain pump according to the invention.
Figure 6B:
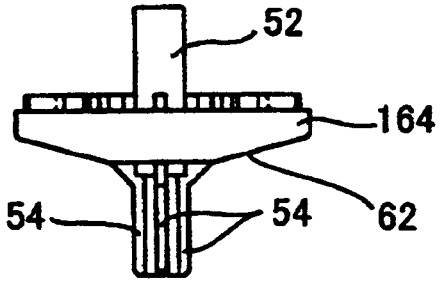

FIG. 6 shows another embodiment of the rotary impeller used in the drain pump according to the invention. In the rotary impeller 110, the position of an upper edge portion of a ring member 164 is lower than the positions of upper edge portions of auxiliary blades 104 and large-diameter blades 101. An arc-shaped chamfered portion (not shown) may be formed at the inside of the upper edge portion of the ring member 164. The ring member 164 is formed as described above, air bubbles, which are generated in the liquid around the large-diameter blade 101, smoothly flow to an outlet 46. Accordingly, the collision between the air bubbles and a bottom face 35 of a cover 32 is mitigated, so that noise is reduced.

Further, return water, which returns to a pump chamber 44 in a casing from the outlet 46, is generated when the drain pump is stopped. The return water bumps against the ring member 164 having a low height and is gradually diffused due to the buffering of the ring member 164, so that noise caused by the return water is also reduced. Furthermore, if the arc-shaped chamfered portion has a radius of curvature substantially equal to, for example, the thickness of the ring member 164, drain water, which receives energy and flows in the radial direction by the rotation of the large-diameter blades 101 or the auxiliary blades 104, smoothly crosses over the upper edge portion of the ring member 164, that is, the flow of the air bubbles becomes smooth and is directed to the outlet 46. As a result, it may be possible to achieve reduction in noise.

A lower end portion of the ring member 164 is connected to an annular member 62, which connects the lower edge portions of the auxiliary blades 104 and the large-diameter blades 101, in an annular shape. Meanwhile, in FIG. 6, the ring member 164 and the annular member 62 have been formed integrally with each other. However, it goes without saying that the ring member and the annular member may be formed separately from each other. The surface of drain water supplied upward from the inlet 42 is divided substantially in a vertical direction by the annular member 62, so that the amount of water coming into contact with the large-diameter blades 101 is decreased and the generation of air bubbles is suppressed. The inner peripheral portion of the annular member 62 has an opening 63 between the central portion of the rotary impeller 110 and itself. The lower edge portions of the auxiliary blades 105 and the large-diameter blades 101 are formed to be inclined toward small-diameter blades 54, and the annular member 62 is also formed in the shape of a dish so as to correspond to the inclination of the lower edge portions.

Figure 9:
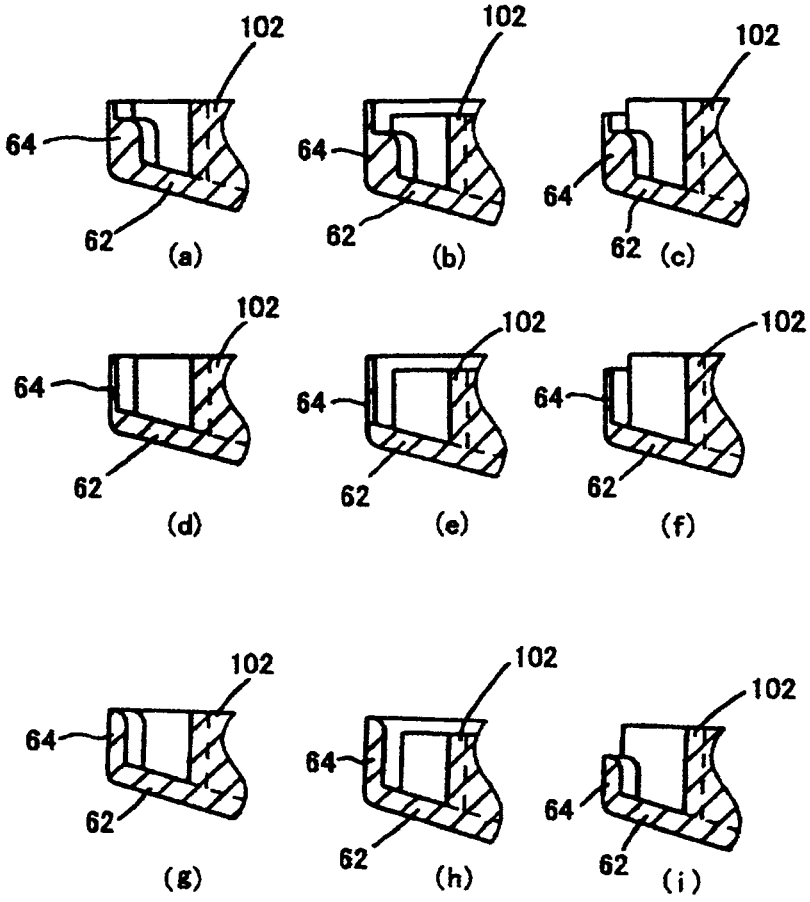
FIG. 9 is a cross-sectional view of a portion of an embodiment of the rotary impeller used in the drain pump according to the invention.

FIG. 9 shows a cross-sectional view of a portion of the rotary impeller of the drain pump according to the invention. FIG. 9A is a partial cross-sectional view of FIG. 2, and the other views of FIG. 9 are partial cross-sectional views of an embodiment having a shape different from that shown in FIG. 2. As shown in these embodiments, a large-diameter blade 101 is divided into inner and outer blades 102 and 103 regardless of the shape of the ring member 64 or the position of the upper edge portion of the ring member. Accordingly, cavitation caused by the burst of air bubbles is decreased, so that noise and vibration may be reduced.

Figure 10A:
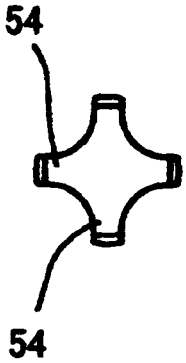
FIG. 10 is a bottom view of a modification of a small-diameter blade of the rotary impeller used in the drain pump according to the invention.
Figure 10B:
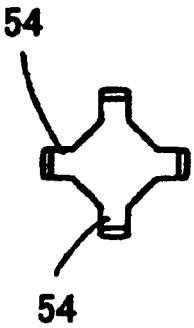
Figure 10C:
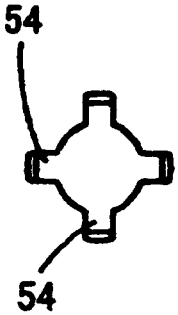

FIG. 10 shows a bottom view of a modification of the small-diameter blade of the rotary impeller used in the drain pump according to the invention. In the embodiment shown in FIG. 2, the area of the opening of the inlet and the area of the flow passage of the drain pump according to the invention have been set to be equal to those of the drain pump in the related art, in order to maintain the same pump performance, such as a head and the amount of discharged water, as the pump performance of the drain pump in the related art. It may be possible to adjust the area of the opening of the inlet and the area of the flow passage by forming the small-diameter blade in the shape shown in FIG. 10 according to the required pump performance.

Figure 7:
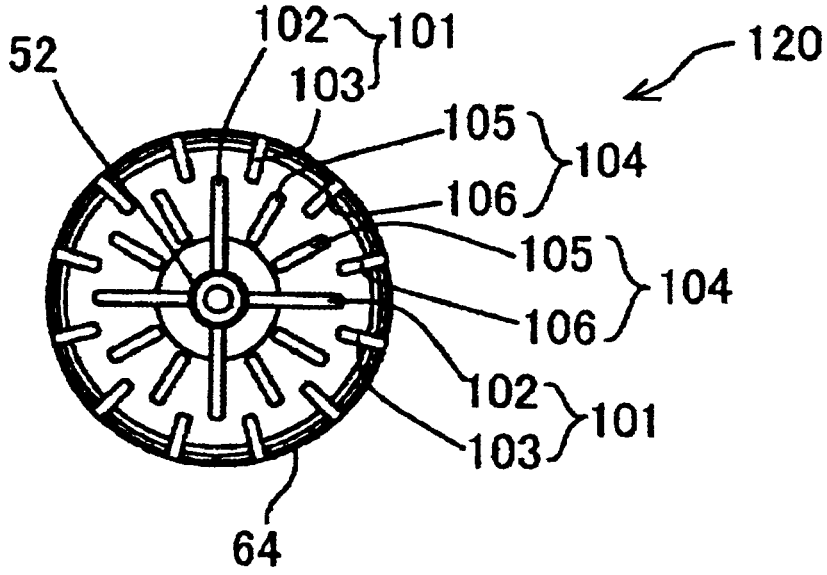
FIG. 7 is a view showing still another embodiment of the rotary impeller used in the drain pump according to the invention.

FIG. 7 shows still another embodiment of the rotary impeller used in the drain pump according to the invention. In the rotary impeller 120, a plurality of auxiliary blades 104 and 104 is disposed between large-diameter blades 101 and 101 that are adjacent to each other. In this embodiment, the number of the auxiliary blades 104 is two. However, the number of the auxiliary blades is not limited thereto and may be three or more. The plurality of auxiliary blades 104 and 104 is disposed around the shaft portion 52 between the adjacent large-diameter blades 101 and 101 at regular intervals. That is, in this embodiment, the large-diameter blades 101 are disposed around the shaft portion 52 at intervals of 90°, and two auxiliary blades 104 are disposed between the adjacent large-diameter blades 101 and 101. Accordingly, inner blades 102 and inner auxiliary blades 105 are disposed around the shaft portion 52 at intervals of 30°, and outer blades 103 and outer auxiliary blades 106 are also disposed around the shaft portion 52 at intervals of 30°. Considering all of the inner and outer blades, the respective blades are disposed at intervals of 15°.

Figure 8:
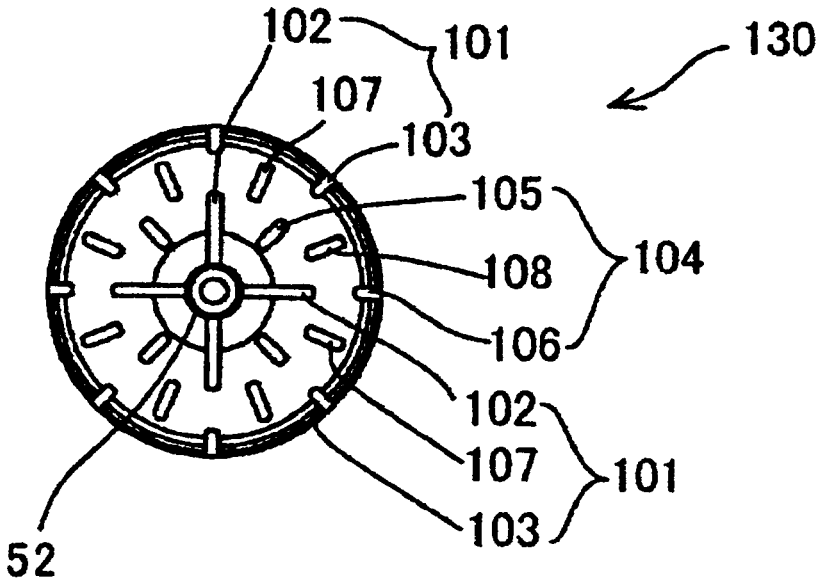
FIG. 8 is a view showing yet another embodiment of the rotary impeller used in the drain pump according to the invention.

FIG. 8 shows yet another embodiment of the rotary impeller used in the drain pump according to the invention. In the rotary impeller 130, each of a large-diameter blade 101 and an auxiliary blade 104 is divided into three members in a radial direction of a shaft portion 52. That is, each of the large-diameter blades 101 is divided into an inner blade 102, an outer blade 103, and an intermediate blade 107. Each of the auxiliary blades 104 is divided into an inner auxiliary blade 105, an outer auxiliary blade 106, and an intermediate auxiliary blade 108. The inner blades 102, the intermediate blades 107, the inner auxiliary blades 105, and the intermediate auxiliary blades 108 are sequentially disposed around the shaft portion 52 so as to be shifted relative to each other. The intermediate blades 107, the intermediate auxiliary blades 108, the outer blades 103, and the outer auxiliary blades 106 are alternately disposed around the shaft portion 52. The intermediate blades 107 are disposed around the shaft portion 52 so as to be shifted relative to the inner auxiliary blades 105 and the outer auxiliary blades 106. The intermediate auxiliary blades 108 are disposed around the shaft portion 52 so as to be shifted relative to the inner blades 102 and the outer blades 103. Accordingly, like in the case of the preceding embodiment, the end portions of the respective blades are not connected to each other, so that an escape route for gas is provided in the vicinity of a gas-liquid boundary.

Figure 14:
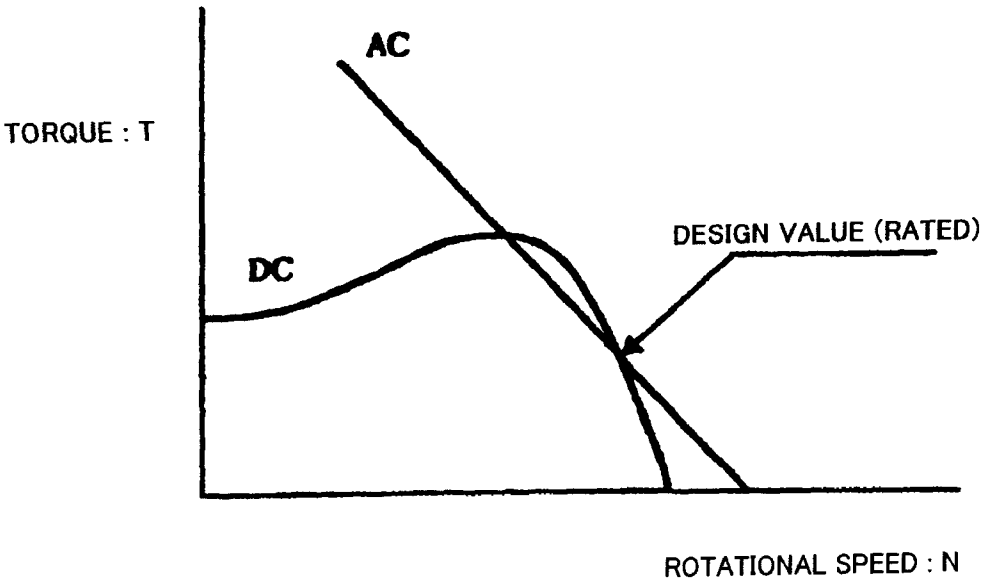
FIG. 14 is a graph showing a relationship between rotational speed and torque of an AC motor and a DC motor.

Meanwhile, any one of an AC motor and a DC motor may be employed as a motor of the drain pump according to the invention. When a head is low, if a load is lower, and rotational speed is faster, then a gas-liquid boundary surface is spread more widely and the increase of cavitation noise and vibration, which is caused by the collision of air bubbles during the scooping of water, is apt to occur. However, due to the difference in characteristics of motors as shown in FIG. 14, when a load is low, the rotational speed of a DC motor tends to increase. Accordingly, when the invention is applied to a DC pump, it may be possible to obtain more effects.

Figure 15:
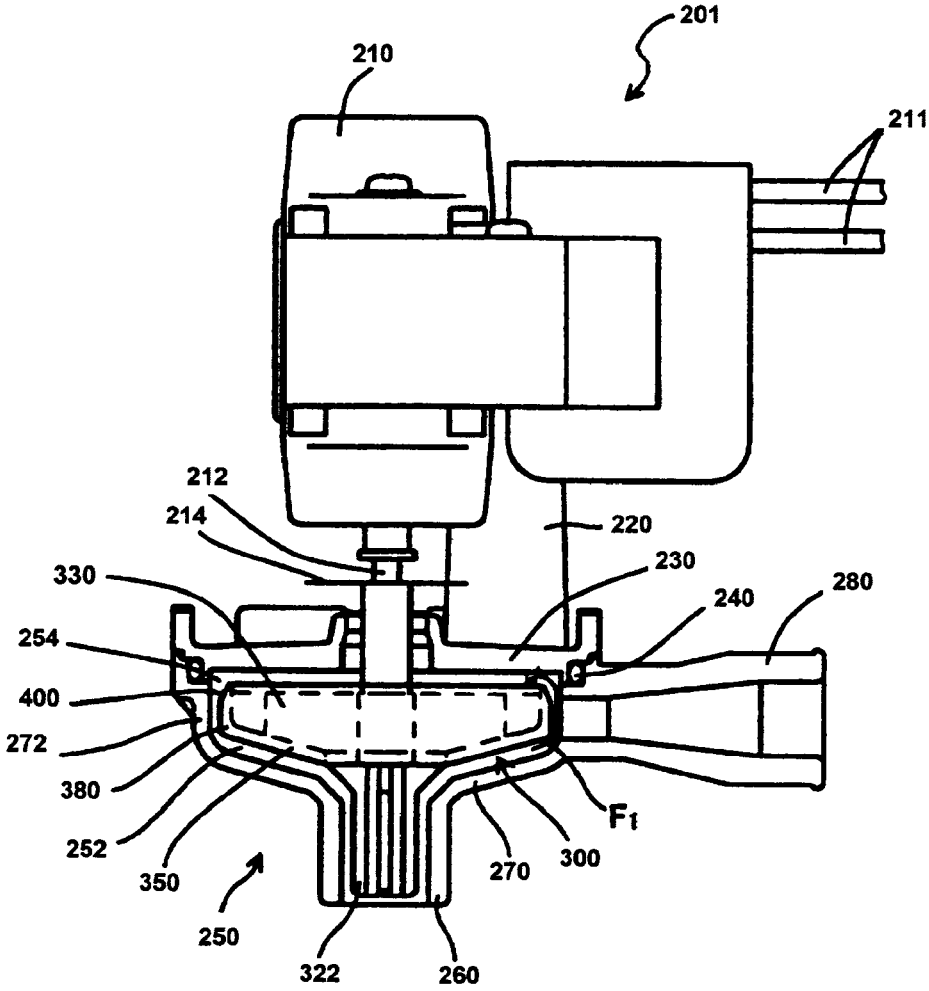
FIG. 15 is an explanatory view showing the drain pump according to the invention.

FIG. 15 is an explanatory view showing a drain pump to which the invention is applied.

The drain pump, which is denoted by reference numeral 201, includes a motor 210, and current is supplied to the motor 210 through lead wires 211. The motor 210 is mounted on a support column 220 that is erected on a lid member 230 mounted on an upper portion of a housing 250.

The housing 250 is made of plastic and a pump chamber 252 is formed in the housing. An upper portion of the housing 250 is surrounded by a cylindrical part 272, and an outlet 280 and an inlet 260 communicating with the pump chamber 252 are formed integrally with each other. The axes of the inlet 260 and the outlet 280 are orthogonal to each other, and the inlet and the outlet are connected to each other by a tapered annular member 270 of the housing 250.

A rotary impeller 300 is disposed in the pump chamber 252, and an opening of the pump chamber 252 is covered with the lid member 230. Since a seal member 240 is interposed between the housing 250 and the lid member 230, drain water is prevented from leaking from the pump chamber.

Figure 16A:
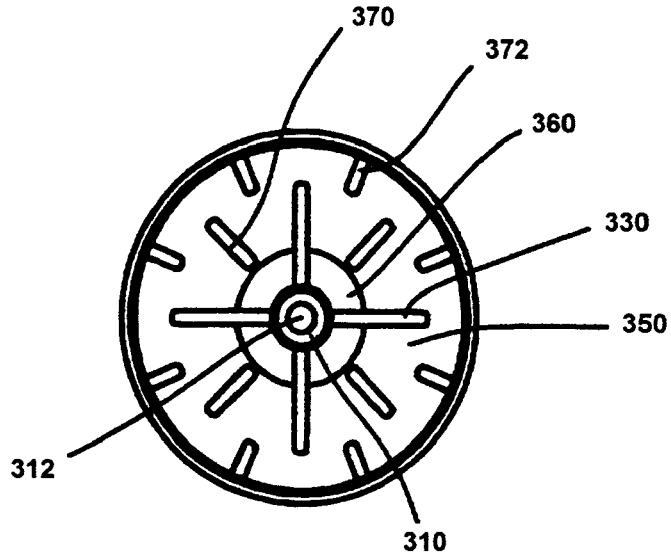
FIG. 16A is a top view of the rotary impeller.
Figure 16B:
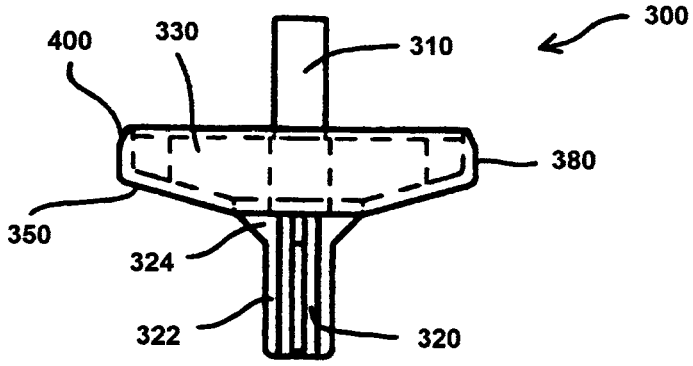
FIG. 16B is a front view of the rotary impeller.
Figure 16C:
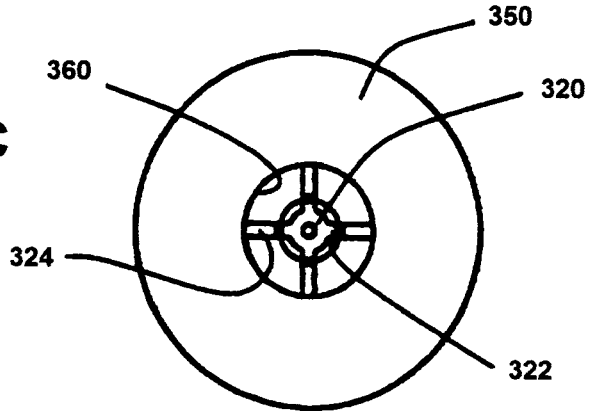
FIG. 16C is a bottom view of the rotary impeller.

FIG. 16A is a top view of the rotary impeller 300, FIG. 16B is a front view of the rotary impeller, and FIG. 16C is a bottom view of the rotary impeller.

The rotary impeller 300 includes a shaft portion 310, and an output shaft 212 of the motor 210 is inserted into a hole 312 of the shaft portion 310. Four plate-like large-diameter blades 330 which extend from the shaft portion 310 in the radial direction are provided.

A small-diameter blade shaft portion 320 is formed concentrically with the shaft portion 310. The small-diameter blade shaft portion 320 is formed to have a diameter smaller than the diameter of the shaft portion 310, and the cross-sectional shape of the small-diameter blade shaft portion may be an appropriate shape, such as a quadrangular shape or a polygonal shape, other than a circular shape.

Further, four plate-like small-diameter blades 322 which protrude outward from the small-diameter blade shaft portion 320 are provided.

An upper end portion of each of the small-diameter blades 322 is connected to each of the large-diameter blades 330 through a connecting portion 324 that has an inclined side surface. An opening 360 is formed at the central portion of a tapered annular member 350 of the rotary impeller, and an outer peripheral portion of the annular member 350 for guiding water, which is scooped up by the small-diameter blades 322, to the large-diameter blades 330 is connected to a ring member 380. Auxiliary blades 372 are formed on the inner surface of the ring member 380. Further, auxiliary blades 370 are also formed on the inner surface of the tapered annular member 350. The number of the auxiliary blades may be appropriately selected.

Furthermore, at a tip end portion of the large-diameter blade 330 may extend up to the inner surface of the ring member 380.

FIG. 17 shows various shapes of an outer portion of an upper edge portion of the ring member 380 of the rotary impeller.

Figures 17A, 17B, 17C:
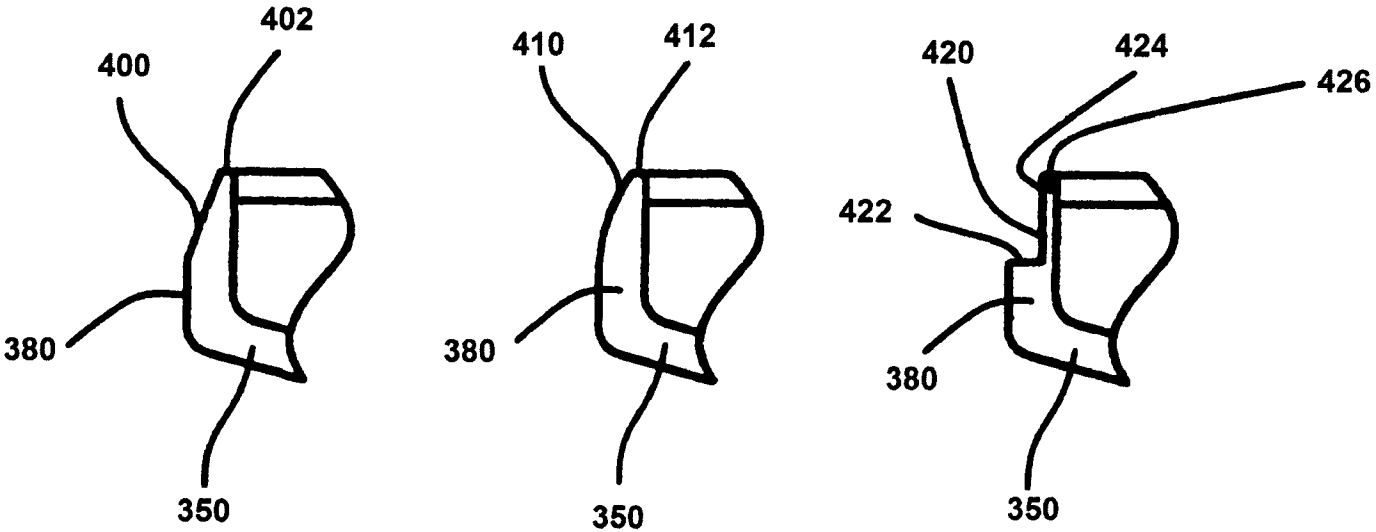
FIG. 17 is an explanatory view showing the shapes of an outer portion of an upper end portion of a ring member.

FIG. 17A shows an example where a tapered portion 400 is formed at the outer portion of the upper edge portion.

The rotary impeller 300 of the invention includes the tapered portion 400 formed at the outer portion of an upper edge portion of the ring member 380. The thickness of the upper edge portion 402 of the ring member 380 is decreased due to the tapered portion 400.

Meanwhile, an upper space 254 of the pump chamber 252 is expanded as shown in FIG. 15. If the expanded space 254 is formed, water in the pump chamber 252 is apt to be introduced into the ring member 380 of the rotary impeller 300 as shown by an arrow $F_1$ at the time of the start-up of the pump. Accordingly, the gas-liquid boundary surface becomes stable early, and it may be possible to reduce discontinuous sound caused by the pulsation at the outer edge portion of the rotary impeller. Further, the collision and burst of air bubbles, which are generated near the ring member 380 by the expanded space 254, are suppressed, so that cavitation noise is reduced.

FIG. 17B shows an example where an arc-shaped surface 410 is formed at the outer portion of the upper edge portion of the ring member 380. The thickness of an upper edge portion 412 is decreased due to this structure, so that an expanded space of the pump chamber may be formed.

FIG. 17C shows an example where a stepped portion 420 is formed at the outer portion of the upper edge portion of the ring member 380. The stepped portion 420 includes a horizontal surface 422 and an outer peripheral surface 424, and the thickness of an upper edge portion 426 is reduced. Accordingly, an expanded space may be formed in the pump chamber.

Figure 18:
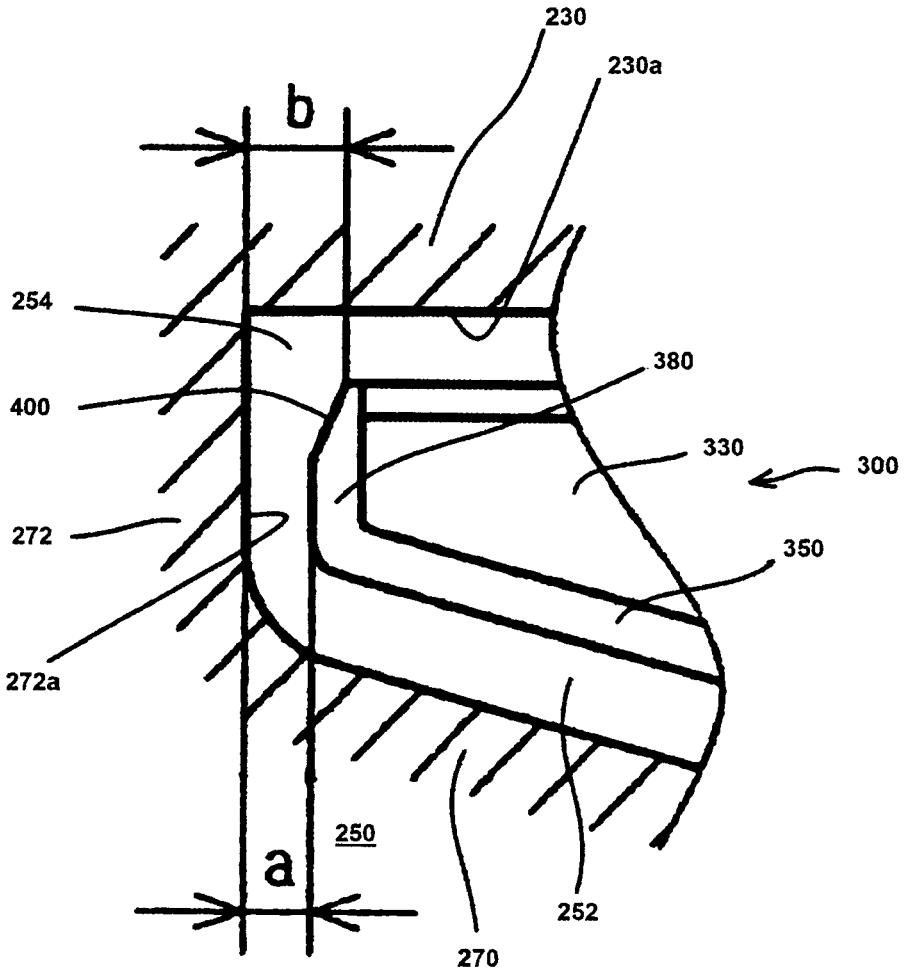
FIG. 18 is a cross-sectional view of main portions of the rotary impeller and a housing of the drain pump according to the invention.

FIG. 18 is a cross-sectional view of main portions of the rotary impeller and the housing of the drain pump according to the invention.

An inner wall portion 272*a* of the cylindrical part 272 of the housing 250 and an inner wall portion 230*a* of the lid member 230 form the pump chamber. In the invention, the tapered portion 400 is formed at the outer peripheral portion of the upper edge of the ring member 380 of the rotary impeller 300.

Meanwhile, a distance a between the inner wall portion 272*a* of the cylindrical part 272 of the housing and the outer peripheral surface of the ring member 380 of the rotary impeller 300 is increased to a distance b at the upper edge portion of the ring member 380, so that the expanded space 254 is formed.

Accordingly, the following effects may be obtained.

1) The resistance of water, which is sucked at the time of the start-up of the drain pump, against the flow passage is reduced, so that water is apt to be introduced to the large-diameter blades and time required to make the gas-liquid boundary surface stable is decreased. As a result, it may be possible to reduce discontinuous sound (sound caused by the pulsation of the gas-liquid boundary surface).

2) It may be possible to reduce cavitation noise generated when air bubbles generated by a cylindrical wall member collide with an inner wall of the casing.

Noise generated, particularly when a load is low, is reduced in the drain pump according to the invention.

Such an operating condition is generally a condition where surroundings are quiet, for example, a condition where a user is asleep. Since noise from the drain pump is to be reduced when surroundings are quiet, it is very effective.

Figure 19:
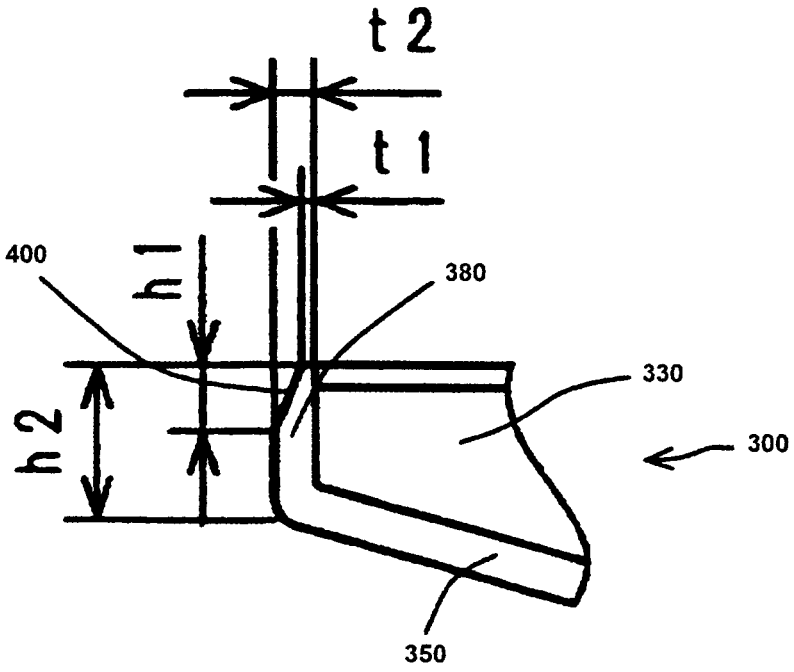
FIG. 19 is an explanatory view showing examples of dimensions of portions of the ring member 380 of the rotary impeller 300.

FIG. 19 shows examples of dimensions of respective portions of the ring member 380 of the rotary impeller 300.

The height $h_1$ of the tapered portion 400 is in the range of 0.7 to 6.0 mm.

The height $h_2$ of the ring member 380 is in the range of 1.5 to 7.0 mm.

A ratio $h_1/h_2$ is in the range of 0.10 to 0.85.

The thickness $t_1$ of the upper edge portion of the ring member 380 is in the range of 0.5 to 2.0 mm.

The thickness $t_2$ of the ring member 380 is in the range of 0.7 to 2.5 mm.

A ratio $t_1/t_2$ is in the range of 0.20 to 0.80.

Figure 20:
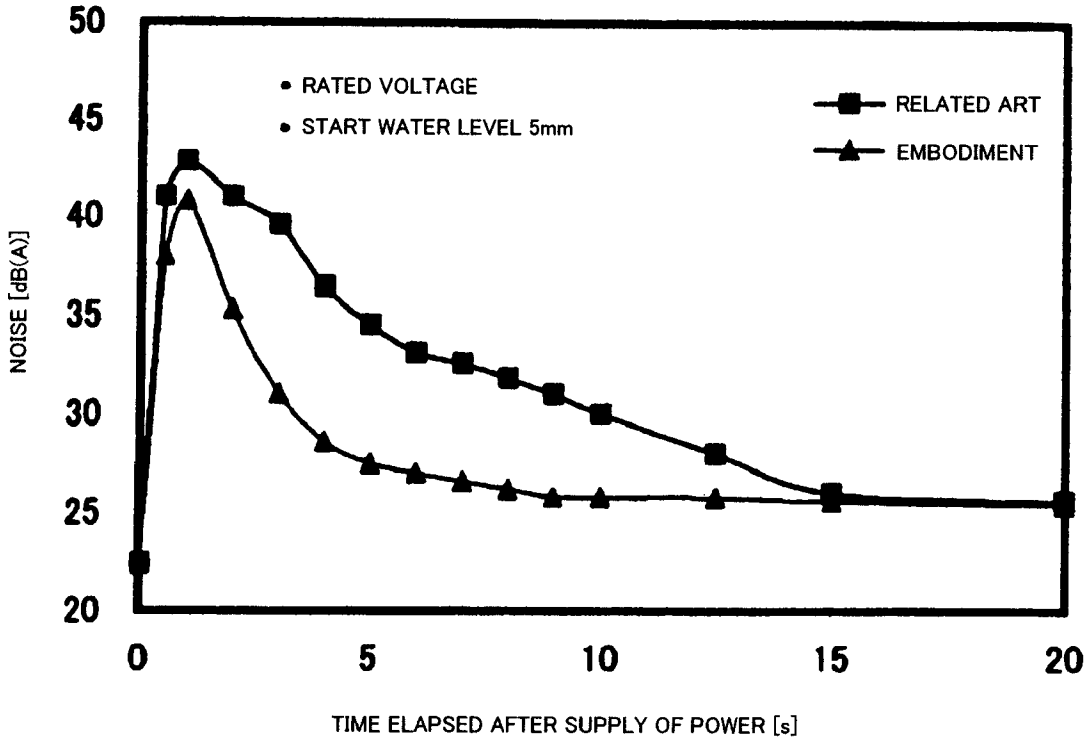
FIG. 20 is a graph illustrating the effect of the invention.
Figure 21:
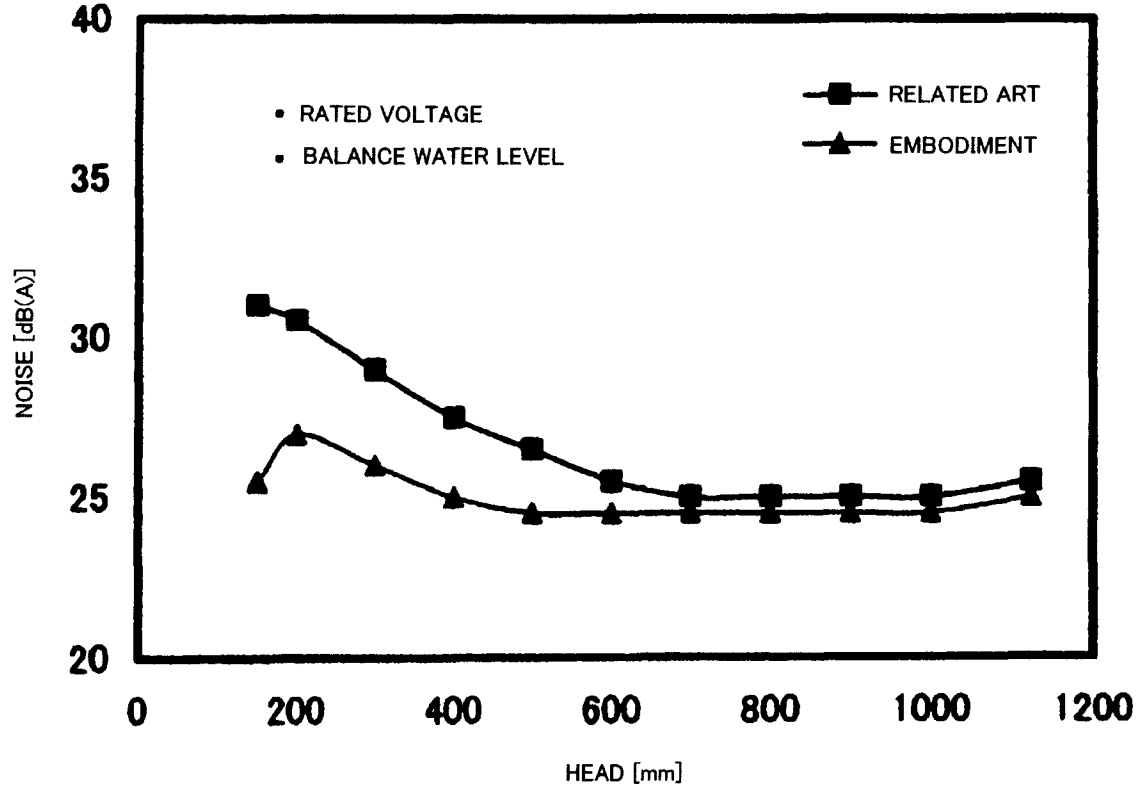
FIG. 21 is a graph illustrating the effect of the invention.

FIGS. 20 and 21 are graphs illustrating the effect of the invention.

FIG. 20 shows an experimental example of a pump provided with the rotary impeller shown in FIG. 17A.

In the graph of FIG. 20, a horizontal axis represents the time (sec.) elapsed after the supply of power and a vertical axis represents a noise level.

It was apparently found that a noise reduction effect of the drain pump using the rotary impeller of the invention shown by triangular marks was larger than that of the drain pump in the related art shown by square marks. A start water level in the graph means a distance where the lower end face of a pump inlet 60 is sunk from the surface of water.

FIG. 21 shows an experimental example that uses the same pump as the pump of FIG. 20.

In the graph of FIG. 21, a horizontal axis represents the head of the pump and a vertical axis represents a noise level.

It was apparently found that a noise reduction effect of the drain pump using the rotary impeller of the invention shown by triangular marks was larger than that of the drain pump in the related art shown by square marks. The head of the horizontal axis is a value obtained by representing the head from the lower surface of a drain pan by millimeter, and a balance water level represents the operating condition of the pump when the head is maintained. Water sucked by the drain pump is stored in the drain pan, and the pump is disposed so that the lower end of the pump is positioned above the lower surface of the drain pan by about 10 mm.

It has been found that a noise reduction effect is obtained in the invention as described above by an experiment.

What is claimed is:

1. A drain pump for an indoor unit of an air-conditioner comprising:

a motor;

a rotary impeller connected to an output shaft of the motor; and a housing that includes an inlet formed at a lower end portion thereof and an outlet formed at a side portion thereof, the rotary impeller being rotatably received in the housing, wherein the rotary impeller includes a shaft portion connected to the output shaft of the motor, a plurality of plate-like large-diameter blades that extends from the shaft portion in a radial direction, a plurality of plate-like small-diameter blades connected to lower edge portions of the large-diameter blades and is received in the inlet, and a ring member connected to outer peripheral portions of the large-diameter blades, each of the large-diameter blades is divided into an inner blade that extends outward from the shaft portion with a leading end thereof being separated from the ring member, and a corresponding outer blade that extends inward from the ring member with a leading end thereof being separated from the shaft portion, and the inner and outer blades of the large-diameter blades are alternately disposed around the shaft portion, the rotary impeller further includes plate-like auxiliary blades, which extend in the radial direction, between the large-diameter blades that are adjacent to each other in a circumferential direction of the shaft portion, each of the auxiliary blades is divided into an inner auxiliary blade that extends in the radial direction between the shaft portion and the ring member, and an outer auxiliary blade that extends inward from the ring member, and the inner blades and the inner auxiliary blades, and the outer blades and the outer auxiliary blades are alternately disposed around the shaft portion, each auxiliary blade is disposed between two adjacent large-diameter blades, and each outer blade of the large-diameter blade is arranged, with respect to the corresponding inner blade of the large-diameter blade, at a position displaced around the shaft portion by ½ of the angle between the inner blade of the large-diameter blade and the inner auxiliary blade adjacent thereto in the circumferential direction of the shaft portion.

2. The drain pump according to claim 1, wherein a relationship between a distance R1 between the center of the shaft portion and an outer end of the inner blade in the radial direction and a distance R2 between the center of the shaft portion and an inner end of the outer blade in the radial direction satisfies R1≤R2.

3. The drain pump according to claim 1, wherein the inner and outer blades are divided from each other in the vicinity of a gas-liquid boundary.

4. The drain pump according to claim 1, wherein the plurality of auxiliary blades is disposed around the shaft portion between the large-diameter blades, which are adjacent to each other, at regular intervals.

5. A drain pump for an indoor unit of an air-conditioner comprising: a motor; a rotary impeller connected to an output shaft of the motor; and a housing that includes an inlet formed at a lower end portion thereof and an outlet formed at a side portion thereof, the rotary impeller being rotatably received in the housing, wherein the rotary impeller includes a shaft portion connected to the output shaft of the motor, a plurality of plate-like large-diameter blades that extends from the shaft portion in a radial direction, a plurality of plate-like small-diameter blades connected to lower edge portions of the large-diameter blades and is received in the inlet, and a ring member connected to outer peripheral portions of the large-diameter blades, each of the large-diameter blades is divided into an inner blade, an outer blade, and an intermediate blade, the inner blades, the outer blades, and the intermediate blades are sequentially disposed in the circumferential direction of the shaft portion so as to be shifted relative to each other, each of the auxiliary blades is divided into an inner auxiliary blade, an outer auxiliary blade, and an intermediate auxiliary blade, the inner auxiliary blades, the outer auxiliary blades, and the intermediate auxiliary blades are sequentially disposed in the circumferential direction of the shaft portion so as to be shifted relative to each other, the intermediate blades, the intermediate auxiliary blades, the outer blades, and the outer auxiliary blades are alternately disposed around the shaft portion, the intermediate blades are disposed around the shaft portion so as to be shifted relative to the inner auxiliary blades and the outer auxiliary blades, the intermediate auxiliary blades are disposed around the shaft portion so as to be shifted relative to the inner blades and the outer blades, each inner blade of the large-diameter blades extends outward from the shaft portion and terminates at an outer end, and each outer blade of the large-diameter blades extends inward from the ring member towards the shaft and terminates at an inner end, and wherein a relationship between a distance R1 between the center of the shaft portion and the outer end of the outwardly extending inner blade in the radial direction and a distance R2 between the center of the shaft portion and the inner end of the inwardly extending outer blade in the radial direction satisfies $R1 \leq R2$.

6. A drain pump comprising:

a motor;

a rotary impeller connected to an output shaft of the motor; and a housing that receives the rotary impeller, the housing including an inlet formed at a lower portion thereof and an outlet formed at a cylindrical side portion of a pump chamber, wherein the rotary impeller includes a shaft portion connected to the output shaft of the motor, plate-like large-diameter blades that extend from the shaft portion in a radial direction, plate-like small-diameter blades that are connected to the large-diameter blades by connecting portions and are received in the inlet, a ring member provided at outer peripheral portions of the large-diameter blades, and an annular member that is connected to a lower end portion of the ring member and includes an opening at a central portion thereof, and each of the large-diameter blades is divided into an inner blade that extends outward from the shaft portion and terminates at an outer end, and an outer blade that extends inward from the ring member towards the shaft and terminates at an inner end, and the inner and outer blades are alternately disposed around the shaft portion and wherein a relationship between a distance R1 between the center of the shaft portion and the outer end of the outwardly extending inner blade in the radial direction and a distance R2 between the center of the shaft portion and the inner end of the inwardly extending outer blade in the radial direction satisfies $R1 \leq R2$, and an outer portion of an upper edge portion of the-ring member is formed in a shape where the thickness of the ring member is decreased, so that an expanded space is formed between the pump chamber and the outer portion of the upper edge portion of the ring member.

7. The drain pump according to claim 6, wherein the outer portion of the upper edge portion of the ring member is formed in a tapered shape.

8. The drain pump according to claim 6, wherein the outer portion of the upper edge portion of the ring member is formed in an arc shape.

9. The drain pump according to claim 6, wherein the outer portion of the upper edge portion of the ring member is formed in a stepped shape.

* * * * *